US005125575A

United States Patent [19]

Iwanaga

[11] Patent Number: 5,125,575

[45] Date of Patent: Jun. 30, 1992

[54] VALVE

[75] Inventor: Takashi Iwanaga, Kariya, Japan

[73] Assignee: Nippondenso Co., Ltd., Kariya, Japan

[21] Appl. No.: 762,268

[22] Filed: Sep. 20, 1991

Related U.S. Application Data

[63] Continuation of Ser. No. 519,235, May 7, 1990, abandoned.

[30] Foreign Application Priority Data

May 9, 1989 [JP] Japan ..... 1-115542

[51] Int. Cl.[5] ..... F02M 47/02; F02M 51/00

[52] U.S. Cl. ..... 239/96; 239/585.3

[58] Field of Search ..... 239/96, 585; 285/328, 285/330

[56] References Cited

U.S. PATENT DOCUMENTS

| | | | |
|---|---|---|---|
| 1,041,260 | 10/1912 | Erickson | 285/330 |
| 3,680,782 | 8/1972 | Monpetit et al. . | |
| 4,129,256 | 12/1978 | Bader, Jr. et al. | 239/96 |
| 4,349,152 | 9/1982 | Akagi | 239/96 |
| 4,394,856 | 7/1983 | Smith et al. | 239/585 X |
| 4,545,352 | 10/1985 | Jourde et al. . | |
| 4,628,881 | 12/1986 | Beck et al. | 239/96 X |
| 4,719,889 | 1/1988 | Amann et al. . | |
| 4,741,478 | 5/1988 | Teerman et al. | 239/585 X |
| 4,753,212 | 6/1988 | Miyaki et al. . | |
| 4,777,921 | 10/1988 | Miyaki et al. . | |
| 4,784,101 | 11/1988 | Iwanaga et al. . | |
| 4,946,106 | 8/1990 | Turchi et al. | 239/585 |

FOREIGN PATENT DOCUMENTS

| | | |
|---|---|---|
| 0304745 | 3/1989 | European Pat. Off. . |
| 0304747 | 3/1989 | European Pat. Off. . |
| 0304749 | 3/1989 | European Pat. Off. . |
| 59-165858 | 9/1984 | Japan . |
| 1491957 | 11/1977 | United Kingdom . |

*Primary Examiner*—Andres Kashnikow
*Assistant Examiner*—William Grant
*Attorney, Agent, or Firm*—Cushman, Darby & Cushman

[57] ABSTRACT

A valve having a first valve body including a first contacting surface, a pressurized fluid supply path opening to the first contacting surface and a pressure-controlled chamber opening to the first contacting surface. A second valve body includes a second contacting surface contacting with the first contacting surface and a valve path whose ends open to the second contact surface, and which connects fluidly the pressurized fluid supply path to the pressure-controlled chamber. A valve is arranged in the second valve body and moved to a closed or open position at which the valve means does or does not cut off the fluidal connection between the pressurized fluid supply path and the pressure-controlled chamber. An actuator arranged on the second valve body moves the valve to the closed or opened position. A first drawing means presses the first contacting surface and the second contacting surface against each other. A second drawing means sets the actuator on the second valve body. The force of the first drawing means is not applied to the actuator and therefore the operation of the actuator is not disturbed by the force pressing the first contacting surface and the second contacting surface against each other. Also, the actuator can be removed from the valve without dissembling the first and second valve bodies.

20 Claims, 5 Drawing Sheets

VALVE

This is a continuation of application Ser. No. 07/519,235, filed on May 7, 1990, which was abandoned upon the filing thereof.

BACKGROUND OF THE INVENTION AND RELATED ART STATEMENT

The present invention relates to a valve which includes an actuator for moving a value plunger to shut or open a port.

As shown in FIG. 4, in a conventional fuel injector disclosed in Japanese Patent Unexamined Publication No. 59-165858, the fuel injector 100 includes an injection valve 110 for injecting high-pressure fuel and a three way electro-magnetic valve 120 for operating the injection valve 110 to control injecting-timing and the volume of the injected fuel.

The injection valve 110 has a first body 113 including a fuel supply path 111 and a pressurized chamber 112. And the first body 113 contains a hydraulic piston 114 connected mechanically to a nozzle (not shown in FIG. 4).

The three-way electro-magnetic valve 120 has a coil 126, a housing 127, a spacer 128 and a second valve body 124 including a first path 121, a second path 122 and a third path 123. The second valve body 124 contains a valve 125 which causes the second path 122 to communicate with the first path 121 or alternatively with the third path 123.

In the fuel injector 100, when the second path 122 is caused by the valve 125 to communicate with the first path 121, the high-pressure fuel flows from the fuel supply path 111 to the pressurized chamber 112 through the first path 121, the valve 125 and the second path 122 so that the pressure in the pressurized chamber 112 becomes high. When the increased pressure in the pressurized chamber 112 presses the hydraulic piston 114 downwardly to operate the nozzle, the nozzle is kept at its closing position.

When the second path 122 is caused by the valve 125 to communicate with the third path 123, the high-pressure fuel is discharged from the pressurized chamber 112 through the second path 122 and the third path 123 so that the pressure in the pressurized chamber 112 becomes low and the hydraulic piston 114 returns upwardly and the nozzle is moved to its open position for injecting the high-pressure fuel.

The injection valve 110 and the three-way electro-magnetic valve 120 contained by a tube-shaped member 140 are tight contacted with each other by an axial force generated by a retaining nut 130 which engages with the tube-shaped member 140 and is driven home thereon, so that fluid communications between the fuel supply path 111 and the first path 121 and between the pressurized chamber 112 and the second path 122 are securely maintained with no leakage therefrom.

In the conventional valve described above, since the housing 127 and the spacer 128 are transformed by the axial force, it is difficult to maintain the movable range of the valve 125 and air-gap 129 at respective desired degrees. Therefore, the three-way electro-magnetic valve 120 can not operate in a stable manner.

OBJECT AND SUMMARY OF THE INVENTION

The object of the present invention is to provide a valve with a valve-plunger-driving actuator, in which the operation of the valve-plunger-driving actuator is not disturbed by a force fixing the parts in the valve.

A valve according to the present invention, comprising, a first body including a first contacting surface, a pressurized fluid supply path opening to the first contacting surface and a pressure-controlled chamber opening to the first contacting surface, a second valve body including a second contacting surface contacting with the first contacting surface and a valve path whose ends open to the second contact surface and which connects fluidly the pressurized fluid supply path to the pressure-controlled chamber, valve means arranged in the second valve body and moved to an opening position at which the valve means does not cut off the fluid connection between the pressurized fluid supply path and the pressure-controlled chamber, or alternatively to a shutting position at which the valve means cuts off the fluid connection between the pressurized fluid supply path and the pressure-controlled chamber, and an actuator arranged on the second valve body and moving the valve means to the opening position or alternatively to the shutting position, wherein the valve further comprises connection means including a singly cylindrical member having a first drawing means which presses the first contacting surface and the second contacting surface against each other, and a second drawing means which sets the actuator on the second valve body.

Since the valve according to the present invention comprises the first drawing means which presses the first contacting surface and the second contacting surface against each other, and the second drawing means which sets the actuator on the second valve body, a force by the first drawing means pressing the first contacting surface and the second contacting surface against each other does not pass through the actuator and is not identical with a force setting the actuator to the second valve body. Therefore, even if the force by the first drawing means pressing the first contacting surface and the second contacting surface against each other is large for fixing securely the first and second valve bodies, the large force is not applied to the actuator and the force by the second drawing means can be kept at a suitable degree so that the actuator is set securely to the second valve body and the operation of the actuator is not disturbed by the force pressing the first contacting surface and the second contacting surface against each other. And the actuator can be removed from the valve without disassembling a unit of the first and second valve bodies.

DETAILED DESCRIPTION OF THE INVENTION

Figure 1:
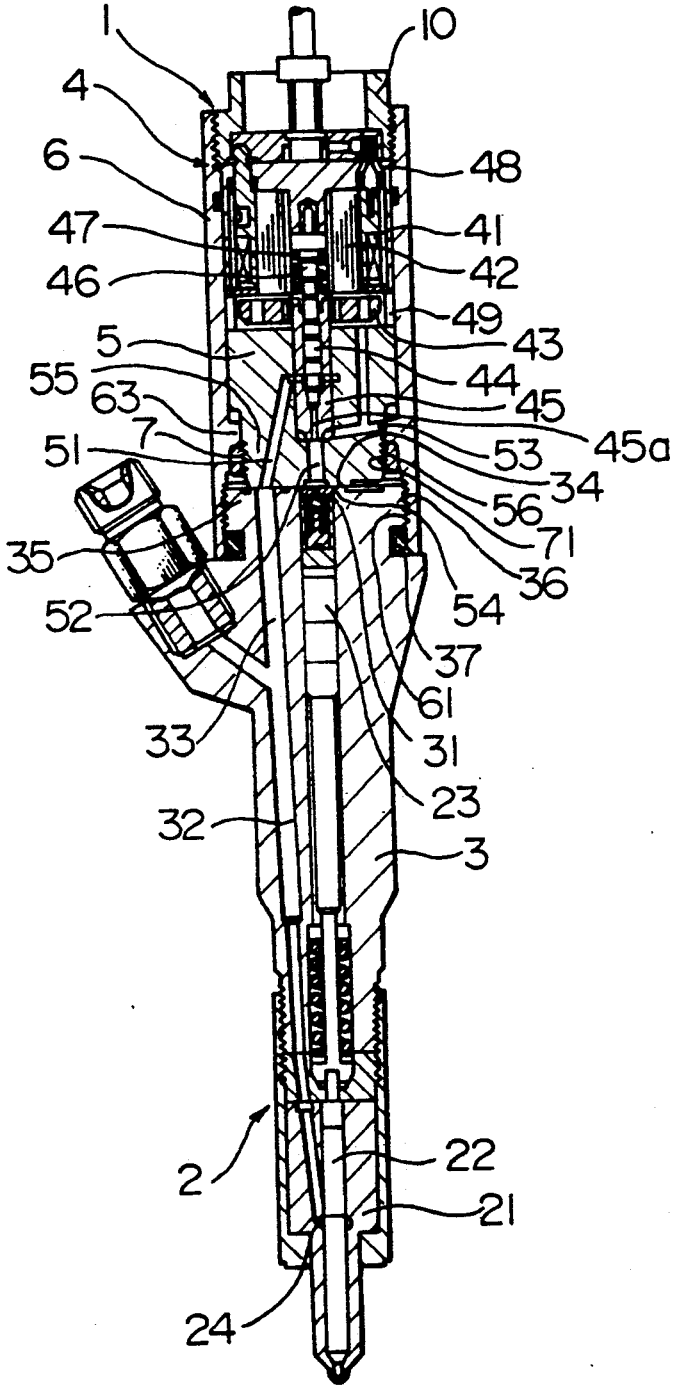
FIG. 1 is a longitudinally cross-sectional view showing an embodiment of the present invention.
Figure 2:
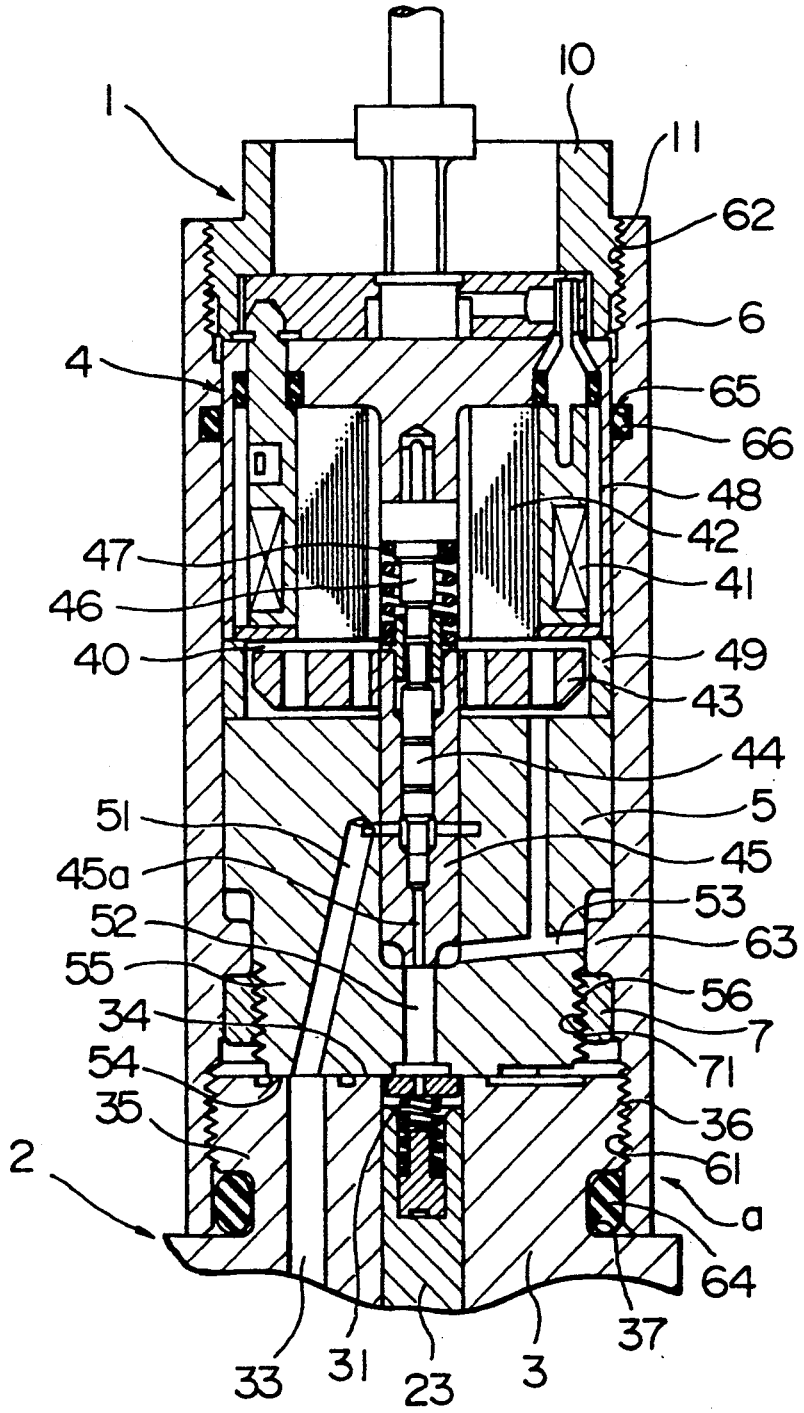
FIG. 2 is a longitudinally cross-sectional enlarged view showing the embodiment of FIG. 1.

As shown in FIGS. 1 and 2, a fuel injector 1 according to the present invention has an injection valve 2, a three-way electro-magnetic valve 4 and a cylindrical member 6. The high-pressure fuel is supplied from a surge tank (not shown) to the fuel injector 1 attached to a cylinder of a diesel engine (not shown).

The injection valve 2 has a nozzle 21, a first body 3, a needle 22 and a hydraulic piston 23. The nozzle 21 includes a fuel chamber 24 which is filled with the high-pressure fuel and from which the high-pressure fuel is injected into the cylinder of the engine when the needle opens a nozzle opening. When a pressure is low in a pressure chamber 31 of the first body 3, the hydraulic piston 23 ascends to open the nozzle opening. When the pressure is high in the pressure chamber 31, the hydraulic piston 23 descends to shut the nozzle opening.

The first body 3 is made of an alloyed steel, for example, SCM 420 (Japanese Industrial Standard G4105) and includes the pressure chamber 31 and fuel paths 32, 33. The pressure chamber 31 opens to a connecting surface 34. The pressure in the pressure chamber 31 increases when the pressure chamber 31 is filled with the high-pressure fuel and descreases when the high-pressure fuel is discharged from the pressure chamber 31. The high-pressure fuel is supplied from the surge tank through the fuel path 32 to the fuel chamber 24 and to the fuel path 33 opening to the connecting surface 34. The first body 3 has an annular groove 37 and a first male thread 36 at its outer peripheral portion adjacent to the connecting surface 34 of an end portion 35. The first male thread 36 is a right-handed screw.

The three-way electro-magnetic valve includes a second body 5, a coil 41, an iron core 42, an armature 43, an inner valve member 44, an outer valve member 45, a stopper 46 and a coil spring 47. The coil 41 and the iron core 42 are arranged in a housing 48 made of aluminum or a non-magnetic stainless steel. When the coil is energized, the coil 41 and the iron core 42 are magnetized to draw the armature 43. When the coil is not energized, an air gap 40 is formed between a lower end surface of the iron core 42 and an upper end surface of the armature 43. A thickness of the air gap 40 is adjusted with a thickness of a ring-shaped spacer 49 made of aluminum or a non-magnetic stainless steel. The armature 43 is arranged in the spacer 49 and is fixed to an upper end of the outer valve member 45.

The inner valve member 44 fits in an inner hole of the outer valve member 45, can slide therein and is pressed upwardly by the high-pressure fluid acting on a lower end of the inner valve member 44. An upward movement of the inner valve member 44 is limited by a lower end of a fixed stopper 46 with a small clearance therebetween. The lower end of the inner valve member 44 contacts in a sealing manner with the inner hole of the outer valve member 45 and a lower end of the outer valve member 45 is apart from a second path 52 fluidly communicating with the pressure chamber 31 of the first body 3 so that a fluid communication between the fuel path 33 and the pressure chamber 31 is shut and a fluid communication between the pressure chamber 31 and a discharge third path 53 is opened when the armature 43 is drawn upwardly by the magnetized coil 41 and iron core 42. The lower end of the inner valve member 44 is apart from the inner hole of the outer valve member 45 and the lower end of the outer valve member 45 engages in a sealing manner with the second path 52 so that the fluid communication between the fuel path 33 and the pressure chamber 31 is opened and the fluid communication between the pressure chamber 31 and the discharge path 53 is shut when the armature 43 is not drawn upwardly but is pressed downwardly by the coil spring 47. When the amount of the upward movement of the inner valve member 44 is changed, the thickness of the spacer 49 is changed. The outer valve 45 includes a communicating path **45*a* connecting fluidly the inner hole of the outer valve member 45 to the second path 52**.

The second body 5 is made of an alloyed steel, for example, SCM 420 (Japanese Industrial Standard G4105) and includes a first path 51, the second path 52 and the discharge third path 53. The first path 51 opens to a connecting surface 54 and connects fluidly the fuel path 33 to the communicating path **45*a* of the outer valve member 45 through the inner hole of the outer valve member 45. The second path 52 opens to a connecting surface 54 and connects fluidly the pressure chamber 31 to the communicating path 451 and to the third path 53. The discharge third path 53 fluidly communicates with the fuel tank and the pressure in the discharge third path 53 is very low in comparison with the pressure in the fuel path 33**.

The second body 5 has a second male thread 56 at an outer peripheral portion of its end portion 55. The second male thread 56 is a left-handed screw, so that the screw direction of the first male thread 36 is opposed to that of the second male thread 56. A cylindrical member 6 engages with the first body 3 and the second body 5 and presses the connecting surface 34 of the first body 3 and the connecting surface 54 of the second body 5 against each other so that the high-pressure fuel is prevented from flowing outside through a portion between the connecting surface 34 and the connecting surface 54.

The cylindrical member 6 is made of a high-carbon steel or preferably a non-magnetic stainless steel and has at an end portion of an inner surface thereof a first female thread 61 engaging with the first male thread 36 of the first body 3 and has at another end portion of the inner surface thereof a second female thread 62 engaging with a male thread 11 arranged on an outer peripheral surface of a retaining nut 10. The cylindrical member 6 has an annular projection 63 engaging with an end surface of a collar 7 made of a high-carbon steel. An O ring 64 of sealing member is set between the cylindrical member 6 and the annular groove 37 of the first body 3. And an O ring 66 of sealing member is set between an annular groove 65 of the cylindrical member 6 and the hausing 48 of the coil 41 of the three-way electro-magnetic valve 4. The collar 7 has at its inner surface a second female thread 71 engaging with the second male thread 56 of the second body 5. An end of the retaining nut 10 contacts with an upper end surface of the three-way electro-magnetic valve 4.

An assembly of the above described embodiment proceeds as follows. At first, the armature 43 is fixed to the outer valve member 45, the inner valve member 44 is inserted into the outer valve member 45 and the outer valve member 45 receiving the inner valve member 44 is inserted into the second valve member 5. The second valve member 5 receiving the armature 43, the inner valve member 4 and the outer valve member 45 is inserted into the cylindrical member 6 through an upper end of the cylindrical member 6. At that time, the end portion 55 of the second body 5 is placed below the annular projection 63 of the cylindrical member 6.

Thereafter, the collar 7 is inserted into the cylindrical member 6 through a lower end of the cylindrical member 6, and the second female thread 71 of the collar 7 is rotated on the second male thread 56 of the second body 5 so that the upper end surface of the collar 7 contacts with a lower end surface of the annular projection 63 of the cylindrical member 6. Subsequently, the first body 3 is inserted into the cylindrical member 6 through the lower end of the cylindrical member 6, and the first female thread 61 of the cylindrical member 6 is rotated on the first male thread 36 of the first body 3 so that the first body 3 is pressed against the second body 5 by the cylindrical member 6. Since the screw direction of the first male thread 36 is opposed to that of the second male thread 56, the collar 7 does not return toward the end of the second body when the first female thread 61 of the cylindrical member 6 is rotated on the first male thread 36 of the first body 3.

The force by the cylindrical member 6 passes through the projection 63, the collar 7 and the second body 5 so that the connecting surface 34 of the first body 3 and the connecting surface 54 of the second body 5 contact tight with each other and the fuel path 33 communicates fluidly with the first path 51 and the pressure chamber 31 communicates fluidly with the second path 52 with no leak of the high-pressure fuel at the connecting surfaces 34 and 54.

Subsequently, the coil 41, the iron core 42, the stopper 46 and the spacer 49 is inserted into the cylindrical member 6 through the upper end of the cylindrical member 6, and at last, the male thread 11 of the retaining nut 10 is rotated on the female thread 62 of the cylindrical member 6 so that the retaining nut 10 fixes the coil 41, the iron core 42, the stopper 46 and the spacer 49 on the second body 5.

Since the force pressing the first body 3 and the second body 5 against each other does not pass through the coil 41, the housing 48 and the spacer 49, the coil 41, the housing 48 and the spacer 49 are not deformed. And since the retaining nut 10 fixes the coil 41, the iron core 42, the stopper 46 and the spacer 49 and does not fix the first body 3 and the second body 5, the fixing force by the retaining nut 10 may be small in comparison with conventional valves. Therefore, the amount of the air gap 40 and the movable range of the inner valve 44 do not vary greatly, so that the operation of the three-way electromagnetic valve 4 is not disturbed.

Further, since the force applied to the hausing 48 and the spacer 49 is small, the thicknesses thereof may be small, so that the magnetized area is increased and the force of the armature 43 generated by the electro-magnet is increased.

Figure 3:
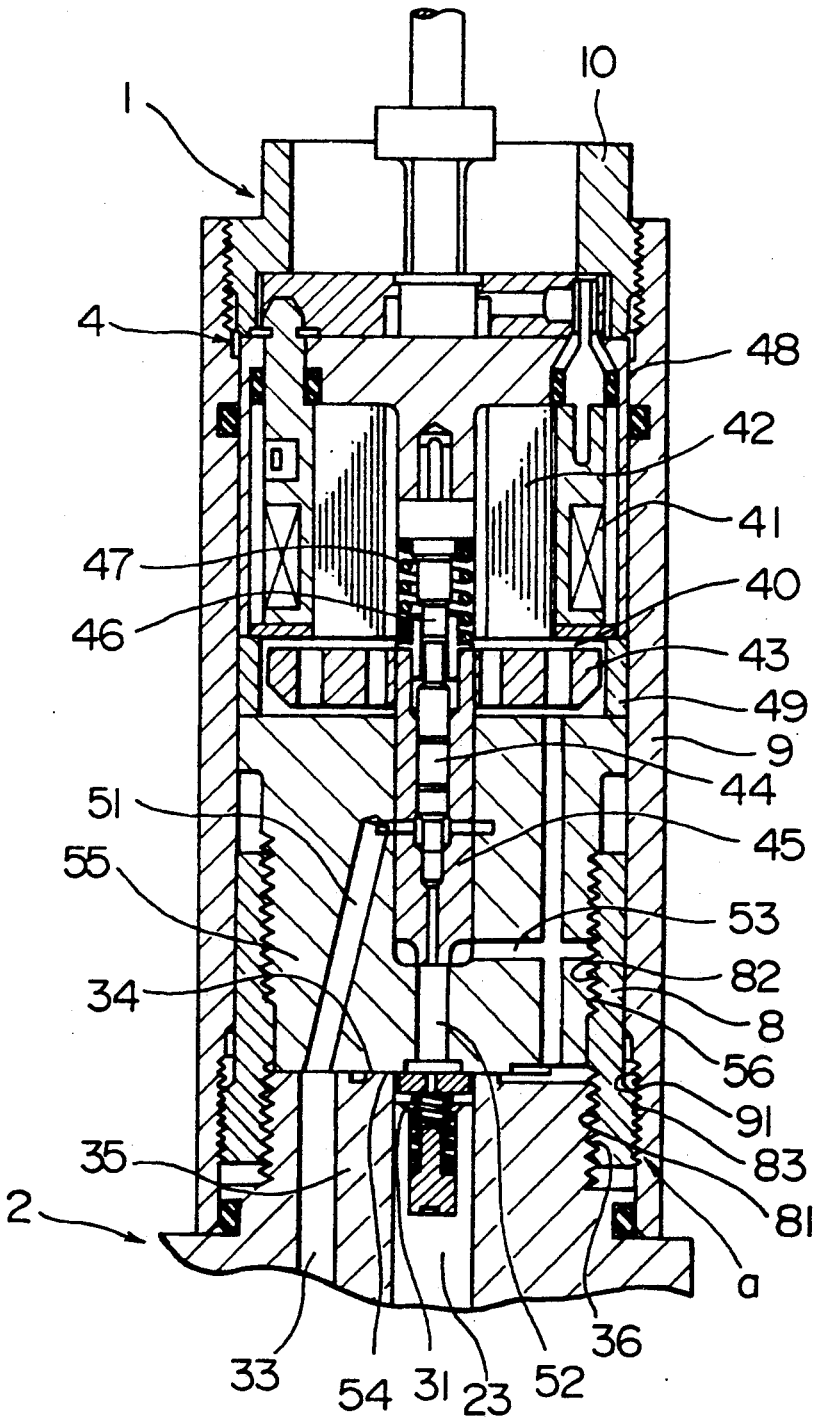
FIG. 3 is a longitudinally cross-sectional view showing another embodiment of the present invention.
Figure 4:
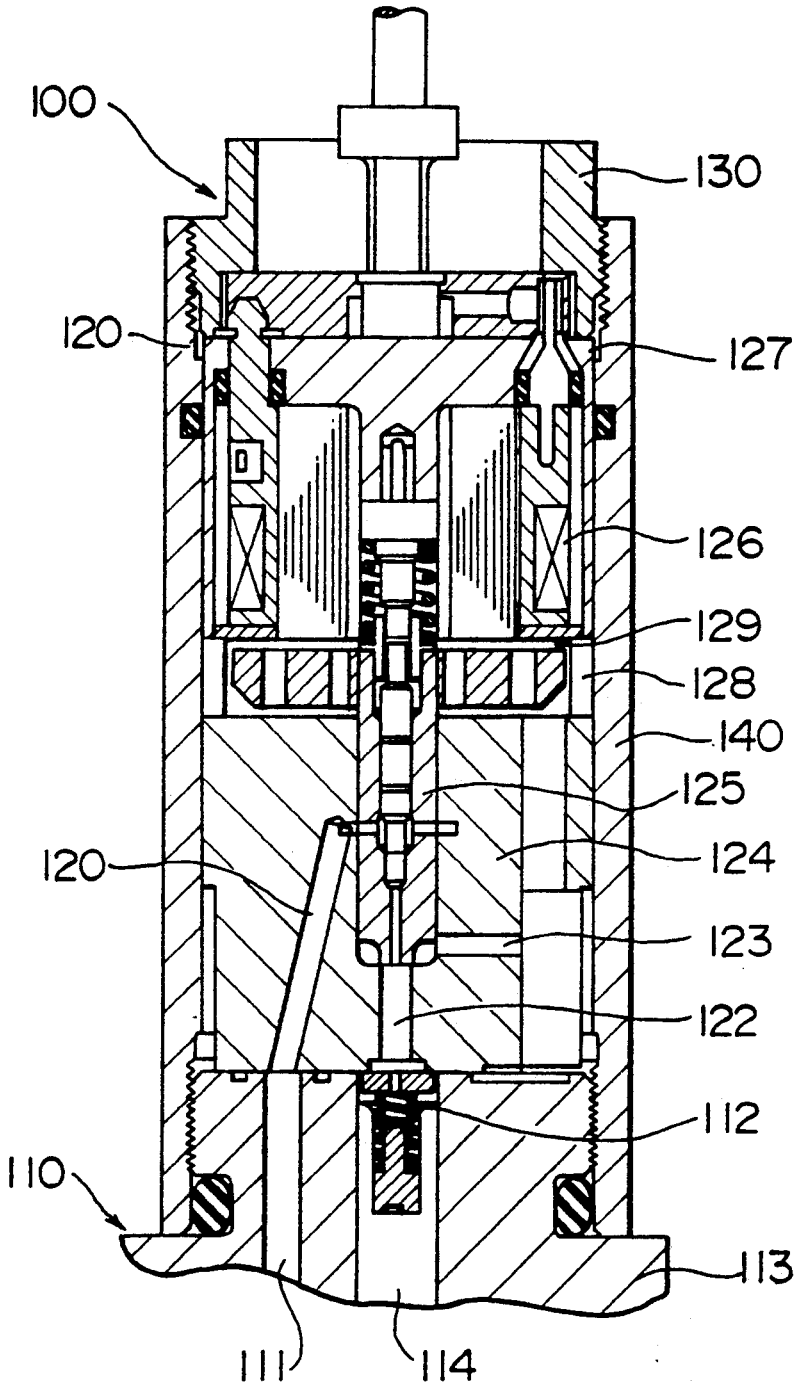
FIG. 4 (PRIOR ART)
FIG. 4 is a longitudinally cross-sectional enlarged view showing a conventional fuel injector.

In FIG. 3 showing another embodiment of the present invention, a collar 8 has at an end of an inner surface thereof a first female thread 81 engaging with the first male thread 36 of the first body 3. And the collar 8 has at another end of the inner surface thereof a second female thread 82 engaging with the second male thread 56 of the second body 5, and the collar 8 has further at an end of an outer peripheral surface thereof a male thread 83 engaging with a female thread 91 of a cylindrical member 9. The cylindrical member 9 engages with the retainer nut 10 in the same way as described above. Since the force pressing the first body 3 and the second body 5 against each other does not pass through the coil 41, the housing 48 and the spacer 49, the coil 41, the housing 48 and the spacer 49 are not deformed.

The first body 3 and the second body 5 may be pressed against each other by bolts and/or nuts. In this case, the first and second valve bodies 3 and 5 have respective flanges through which the bolts pass.

Figure 5:
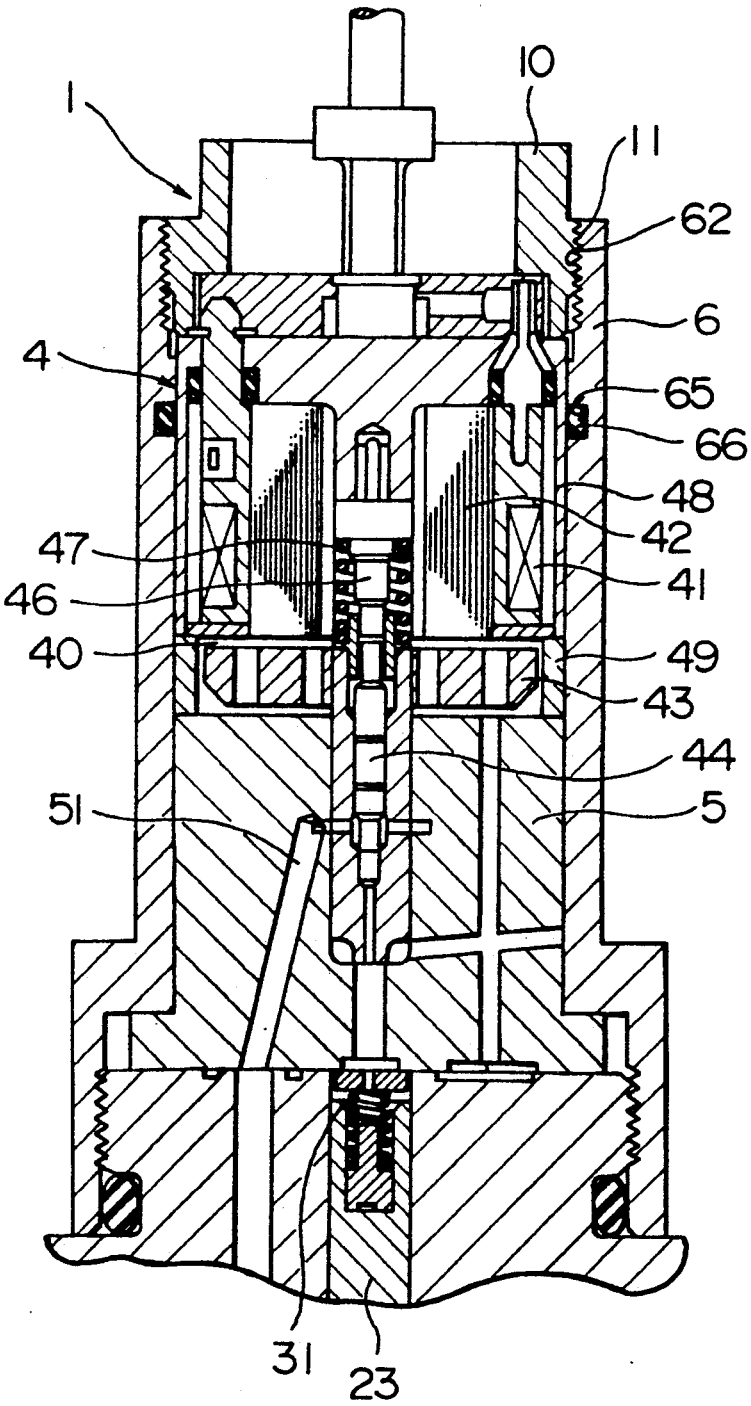
FIG. 5 is a longitudinally cross-sectional view showing the other embodiment of the present invention.

In FIG. 5 showing the other embodiment of the present invention, the second body 5 used in this embodiment does not have a thread which engages with the cylindrical member 6 through a collar 7 or 8 but has a flange which engages directly with the cylindrical member 6.

What is claimed is:

1. A valve comprising:

a first valve body including a first contacting surface, a pressurized fuel supply path opening to the first contacting surface and a pressure-controlled chamber opening to the first contacting surface, a second valve body including a second contacting surface contacting with the first contacting surface and a valve path whose ends open to the second contacting surface and which connects fluidly the pressurized fuel supply path to the pressure-controlled chamber, valve means arranged in the second valve body and moved between an opening position at which the valve means does not cut off fluid connection between the pressurized fuel supply path and the pressure-controlled chamber, and a shutting position at which the valve means cuts off fluid connection between the pressurized fluid supply path and the pressure-controlled chamber, an actuator arranged on the second valve body and moving the valve means between the opening position and the shutting position, and a connection means including a cylindrical member surrounding the second valve body said cylindrical member having a) a first drawing means which engages with the first valve body to prevent a movement of the first valve body relative to the connecting means, and which further engages with the second valve body to prevent a movement of the second valve body relative to the connection means so that the first contacting surface and the second contacting surface are pressed against each other, and b) a second drawing means which sets the actuator on the second valve body.

2. A valve according to claim 1, wherein the connection means includes the cylindrical member engaging with the first body and said connection means further includes a collar which detachably engages with the second valve body and through which the cylindrical member engages with the second valve body to press the first contacting surface and the second contacting surface against each other.

3. A valve according to claim 1, wherein the valve further comprises a nozzle needle, slideably provided in the first valve body and which is pressed by the pressure of the pressure-controlled chamber to prevent the flow of fuel through the nozzle needle.

4. A valve according to claim 3, wherein high-pressure fuel is supplied to the pressurized fuel supply path.

5. A valve according to claim 1, wherein the valve further comprises a nozzle needle, slideably provided in the first valve body and which is pressed by the pressure of the pressurized fluid supply path to allow the flow of the fuel through the nozzle needle.

6. A valve according to claim 1, wherein the second valve body includes a low pressure discharge path, the valve means at the opening position thereof opens the fluid connection between the pressurized fuel supply path and the pressure-controlled chamber, and the valve means at the shutting position thereof opens a fluid connection between the low pressure discharge path and the pressure-controlled chamber, so that the pressue in the pressure-controlled chamber is changed between a low pressure and a high pressure.

7. A valve according to claim 1, wherein the actuator is an electro-magnetic actuator.

8. A valve according to claim 7, wherein the actuator includes an electromagnet and a movable armature driven by the electromagnet to move the valve means, and a predetermined gap exists between the electromagnet and the armature.

9. A valve according to claim 8, wherein a force created by the first drawing means to press the first contacting surface and the second contacting surface against each other is not passed through the actuator so a movable range of the gap is maintained at a predetermined degree.

10. A fuel injector comprising:

a high-pressure fuel supply conduit, a first valve body including a first contacting surface, a pressurized fuel path which opens to the first contacting surface and to which the high-pressure fuel is supplied from the high-pressure fuel supply conduit, and a pressure-controlled fuel chamber opening to the first contacting surface, a second valve body including a second contacting surface contacting with the first contacting surface and a valve path whose ends open to the second contacting surface and which connects fluidly the pressurized fuel path to the pressure-controlled chamber, valve means arranged in the second valve body and moved between an opening position at which the valve means allows a fluid connection between the pressurized fuel path and the pressure-controlled chamber, and a shutting position at which the valve means cuts off the fluid connection between the pressurized fuel path and the pressure-controlled chamber, a nozzle needle, slideably provided in the first valve body, and pressed by the pressure of the pressure-controlled chamber to prevent fuel flow there through, and pressed by the pressure of the pressurized fuel supply path to allow fuel to flow through the nozzle needle, an actuator arranged on the second valve body for moving the valve means between the opening position and the shutting position, and a connection means including a cylindrical member surrounding the second valve body, said cylindrical member having a) a first drawing means which engages with the first valve body to prevent a movement of the first valve body relative to the connection means, and which further engages with the second valve body to prevent a movement of the second valve body relative to the connection means so that the first contacting surface and the second contacting surface are pressed against each other, and b) a second drawing means which sets the actuator on the second valve body.

11. A fuel injector according to claim 10, wherein the connection means includes the cylindrical member engaging with the first body and said connection means further includes a collar which detachably engages with the second valve body and through which the cylindrical member engages with the second valve body to press the first contacting surface and the second contacting surface against each other.

12. A fuel injector according to claim 10, wherein the second valve body includes a low pressure discharge path, wherein the valve means at the shutting position thereof opens a fluidal connection between the low pressure discharge path and the pressure-controlled chamber, so that the pressure in the pressure-controlled chamber is changed between a low pressure and a high pressure.

13. A fuel injector according to claim 10, wherein the actuator is an electro-magnetic actuator.

14. A fuel injector according to claim 13, wherein the actuator includes an electromagnet and a movable armature driven by the electromagnet to move the valve means, and a predetermined gap exists between the electromagnet and the armature.

15. A fuel injector according to claim 14, wherein a force created by the first drawing means to press the first contacting surface and the second contacting surface against each other is not passed through the actuator so a movable range of the gap is maintained at a predetermined degree.

16. A fuel injector comprising:

a high-pressure fuel supply conduit, a first valve body including a first contacting surface, a pressurized fuel path which opens to the first contacting surface and to which the high-pressure fuel is supplied from the high-pressure fuel supply conduit and a pressure-controlled fuel chamber opening to the first contacting surface, a second valve body including a low pressure discharge path, a second contacting surface contacting with the first contacting surface and a valve path whose ends open to the second contacting surface and which connects fluidly the pressurized fuel path to the pressure-controlled chamber, valve means arranged in the second valve body and moved between an opening position at which the valve means opens the fluidal connection between the pressurized fluid supply path and the pressure-controlled chamber, and a shutting position at which the valve means opens a fluidal connection between the low pressure discharge path and the pressure-controlled chamber, so that the pressure in the pressure-controlled chamber is changed between a low pressure and a high pressure, a nozzle needle, slideably provided in the first valve body, and pressed by the pressure of the pressure-controlled chamber to prevent fuel flow there through, and pressed by the pressure of the pressurized fuel supply path to allow fuel to flow through the nozzle needle, an actuator arranged on the second valve body for moving the valve means between the opening position and the shutting position, the second valve body includes, the valve means at the opening position thereof opens the fluidal connection between the pressurized fuel supply path and the pressure-controlled chamber, the vale means at the shutting position thereof opens a fluid connection between the flow pressure discharge path and the pressure-controlled chamber, so that the pressure in the pressure-controlled chamber is changed between a low pressure and a high pressure, and a connection means including a cylindrical member surrounding the second valve body, said cylindrical member having a) a first drawing means which engages with the first valve body to prevent a movement of the first valve body relative to the connection means, and which further engages with the second valve body to prevent a movement of the second valve body to prevent a movement of the second valve body relative to the connection means so that the first contacting surface and the second contacting surface against each other, and b) a second drawing means which sets the actuator on the second valve body.

17. A fuel injector according to claim 16, wherein the connection means includes the cylindrical member engaging with the first body and said connection means further includes a collar which detachably engages with the second valve body and through which the cylindrical member engages with the second valve body to press the first contacting surface and the second contacting surface against each other.

18. A fuel injector according to claim 16, wherein the actuator is an electro-magnetic actuator.

19. A fuel injector according to claim 18, wherein the actuator includes an electromagnet and a movable armature driven by the electromagnet to move the valve means, and a predetermined gap exists between the electromagnet and the armature.

20. A valve according to claim 19, wherein a force created by the first drawing means to press the first contacting surface and the second contacting surface against each other is not passed through the actuator so a movable range of the gap is maintained at a predetermined degree.

* * * * *